US008590995B2

(12) United States Patent
Sayama

(10) Patent No.: US 8,590,995 B2
(45) Date of Patent: Nov. 26, 2013

(54) LIQUID EJECTING APPARATUS AND CONTROL METHOD THEREFOR

(75) Inventor: Tomohiro Sayama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 28 days.

(21) Appl. No.: 13/267,770

(22) Filed: Oct. 6, 2011

(65) Prior Publication Data

US 2012/0086755 A1 Apr. 12, 2012

(30) Foreign Application Priority Data

Oct. 8, 2010 (JP) ..... 2010-228819

(51) Int. Cl.
*B41J 29/38* (2006.01)
*B41J 2/04* (2006.01)

(52) U.S. Cl.
USPC ..... 347/10; 347/54

(58) Field of Classification Search
None
See application file for complete search history.

(56) References Cited

U.S. PATENT DOCUMENTS 6,450,603 B1 * 9/2002 Chang ..... 347/10
6,494,556 B1 * 12/2002 Sayama et al. ..... 347/11

FOREIGN PATENT DOCUMENTS

JP 2009-226587 A 10/2009

* cited by examiner

*Primary Examiner* — Geoffrey Mruk
(74) *Attorney, Agent, or Firm* — Kilpatrick Townsend & Stockton LLP

(57) ABSTRACT

A first activation signal has ejection activation pulses that eject ink from nozzles; a second activation signal has a micro-oscillating activation pulse (non-ejection activation pulse) for inducing pressure fluctuation on ink within the pressure chamber of a level such that liquid is not ejected from the nozzle; a minimum electric potential of the micro-oscillating activation pulse is no greater than a maximum electric potential of the ejection activation pulse; and the ejection activation pulse is supplied to a piezoelectric element corresponding to an ejecting nozzle ejecting ink in a unit cycle, and the micro-oscillating activation pulse is at least supplied to a piezoelectric element corresponding to a non-ejecting nozzle located adjacent to the ejecting nozzle.

5 Claims, 8 Drawing Sheets

LIQUID EJECTING APPARATUS AND CONTROL METHOD THEREFOR

BACKGROUND

1. Technical Field

The present invention relates to a liquid ejecting apparatus such as an ink jet printing apparatus, and particularly to a liquid ejecting apparatus that ejects a liquid from a nozzle by deforming an operation surface constituting one portion of a pressure chamber that is in communication with the nozzle, thereby inducing pressure fluctuation in liquid within the pressure chamber.

2. Related Art

The liquid ejecting apparatus has a liquid ejecting head capable of ejecting liquid as a droplet from a nozzle, and various types of liquid are ejected from the liquid ejecting head. A typical example of such a liquid ejecting apparatus that may be given is an image printing apparatus such as an ink jet printing apparatus having an ink jet print head (hereinafter, "print head") that performs printing by ejecting liquid ink as a droplet from a nozzle of the print head. In addition to this, furthermore, the liquid ejecting apparatus is used to eject various types of liquid, including dyes for use in a color filter of an LCD, an organic material for use in an organic electro luminescence (EL) display, and an electrode material for use in electrode forming. A print head for use in an image printing apparatus ejects a liquid ink, and a dye ejecting head for use in a display fabricating apparatus ejects a solution of dyes of red (R), green (G), and blue (B). Furthermore, an electrode material ejecting head for use in an electrode forming apparatus ejects a liquid electrode material, and a bio-organic matter ejecting head for use in a chip fabricating apparatus ejects a solution of a liquid bio-organic matter.

A print head equipped in the above-described printer is configured so as to introduce ink into a pressure chamber from an ink supply source such as an ink cartridge, activate pressure generating means of inducing pressure fluctuation in ink within the pressure chamber, and eject ink in the pressure chamber as a droplet from a nozzle using the pressure fluctuation. In such a print head a plurality of nozzles are densely installed so as to improve the quality of printed images. Accordingly, the pressure chamber that is in communication with each nozzle is also densely formed, and, As a result, the partitions dividing the adjacent pressure chambers from one another are extremely thin. Due to this, a partition may, for example, bend toward an adjacent pressure chamber side accompanying the pressure fluctuation of ink in the pressure chamber, caused by the activation of the pressure generating means, when ink is ejected from any given nozzle. In regards to this point, if ejection is performed even by adjacent nozzles located on both sides of the ejecting nozzle at the same time, respectively, the internal pressure of the pressure chambers on both sides will also increase, and flexing of the partitions can therefore be suppressed. However, if ejection is not performed by either one of the nozzles on both sides, there is a risk of a partition bending toward the pressure chamber side of the non-ejecting nozzle. When a partition bends toward an adjacent pressure chamber side when ejecting an ink droplet, a pressure loss proportionate to this occurs, and there is a risk of the ejection characteristics of the ink droplet being altered, including a decrease in the velocity of ejected the ink droplet or reduced ink droplet amount.

In this manner, the pressure fluctuation conditions produced within the pressure chamber differ depending on the ejecting nozzles and whether the nozzles on both sides of the ejecting nozzle simultaneously activate, or simultaneously do not activate, and variation of the ejection characteristics in the ejecting nozzles and occurrence of so-called crosstalk caused by this have presented problems. JP-A-2009-226587, for example, proposes a configuration that applies an activation pulse with a voltage smaller than the ejection activating pulse, that is to say, an activation pulse where the pressure fluctuation generated in the pressure chamber is small, like a so-called micro-oscillating activation pulse to the pressure generating means of the non-ejecting nozzle, thereby providing pressure fluctuation of a level at which ink is not ejected into the pressure chamber of the non-ejecting nozzle.

SUMMARY

However, the micro-oscillating pulse described above had the problem of a crosstalk suppression effect not being sufficiently likely, since the pressure oscillation in the non-ejecting nozzle is small in respect to the pressure oscillation in the ejecting nozzle.

Such problems as these are present not only in an ink jet printing apparatus equipped with a print head that ejects ink, but also in other liquid ejecting apparatuses that induce pressure fluctuation in liquid within a pressure chamber by deforming the operation surface, thereby causing liquid to be ejected from a nozzle.

An advantage of some aspects of the invention is to provide a liquid ejecting apparatus capable of preventing crosstalk during liquid ejection and stably ensuring ejection characteristics regardless of the number of nozzles simultaneously ejecting liquid.

According to an aspect of the invention, a liquid ejecting apparatus includes a liquid ejecting head that has a nozzle for ejecting liquid, a pressure chamber in communication with the nozzle, and a pressure generator of deforming an operation surface for sealing an opening surface of the pressure chamber to induce pressure fluctuation in liquid within the pressure chamber and that ejects liquid from the nozzle by activation of the pressure generator; an activation signal generator that generates an activation signal for activating the pressure generator; and a select-and-supply unit that selects an activation pulse contained in an activation signal generated by the activation signal generator and that supplies the pulse to the pressure generator. The pressure generator is configured such that, as an applied electric potential increases above a standard electric potential corresponding to a standard condition where a central portion of the operation surface is located inside of the pressure chamber from the opening surface of the pressure chamber, the central portion of the operation surface is displaced from the standard condition to further inside of the pressure chamber, and, as an applied electric potential decreases below the standard electric potential, the central portion of the operation surface is displaced from the standard condition to outside of the pressure chamber. The activation signal generator includes in the activation signal an ejection activation pulse for ejecting liquid from the nozzle, and a non-ejection activation pulse for inducing pressure fluctuation in liquid within the pressure chamber of a level such that liquid is not ejected from the nozzle. A minimum electric potential of the non-ejection activation pulse is no greater than a minimum electric potential of the ejection activation pulse. The select-and-supply unit supplies the ejection activation pulse to a pressure generator corresponding to an ejecting nozzle ejecting liquid, and supplies the non-ejection activation pulse at least to a pressure generator corresponding to a non-ejecting nozzle located adjacent to the ejecting nozzle.

According to the aspect, the minimum electric potential of the non-ejection activation pulse is set to a value no greater than the minimum electric potential of the ejection activation pulse, the ejection activation pulse is supplied to the pressure generator corresponding to the ejecting nozzle ejecting liquid, and the non-ejection activation pulse is at least supplied to the pressure generator corresponding to the non-ejecting nozzle located adjacent to the ejecting nozzle. Therefore, in the pressure chamber of the non-ejecting nozzle side the operation surface is displaced from the standard condition, causing a condition such that the operation surface pushes the partition dividing the pressure chamber toward the adjacent pressure chamber side, and deforming of the partition toward the non-ejecting nozzle side is suppressed when the pressure in the pressure chamber corresponding to the ejecting nozzle has increased. This enables the pressure loss from the pressure chamber of the ejecting nozzle side to the pressure chamber of the non-ejecting nozzle side to be reduced. As a result, variation of ejection characteristics such as the velocity of ejected liquid and liquid amount, is suppressed regardless of whether ejection is performed simultaneously by a nozzle adjacent to an ejecting nozzle (whether a nozzle located adjacent to an ejecting nozzle is an ejecting nozzle), or whether ejection is not performed simultaneously by a nozzle adjacent to an ejecting nozzle (whether a nozzle located adjacent to an ejecting nozzle is a non-ejecting nozzle).

In the above-described configuration, the following configuration is preferably adopted. The ejection activation pulse at least includes a first dropping element for deforming the operation surface outside in respect to the pressure chamber from the standard condition by dropping a potential from the standard electric potential to the minimum electric potential, a first sustaining element for sustaining the minimum electric potential for a fixed length of time, and a first raising element for deforming the operation surface further inside in respect to the pressure chamber than the standard condition by raising a potential from the minimum electric potential to the standard electric potential. The non-ejection activation pulse at least includes a second dropping element for dropping a potential from the standard electric potential to a minimum electric potential lower than the minimum electric potential of the ejection activation pulse, a second sustaining element for sustaining the minimum electric potential for a fixed length of time, and a second raising element for raising a potential from the minimum electric potential to the standard electric potential.

Furthermore, in the above-described configuration, the following configuration is preferably adopted. The second dropping element of the non-ejection activation pulse occurs prior to the first dropping element of the ejection activation pulse of the same cycle, and the second raising element of the non-ejection activation pulse occurs subsequent to the first raising element of the ejection activation pulse of the same cycle.

According to this configuration, the second dropping element of the non-ejection activation pulse occurs prior to the first dropping element of the ejection activation pulse of the same cycle, and the second raising element of the non-ejection activation pulse occurs subsequent to the first raising element of the ejection activation pulse of the same cycle. Therefore, at least before ejection motion commences due to the ejection activation pulse in the ejecting nozzle, deformation toward the pressure chamber outside from the standard condition of the operation surface by the second dropping element of the ejection activation pulse in the non-ejecting nozzle is completed. Further, at least after ink is ejected by the ejection activation pulse in the ejecting nozzle, returning toward the standard condition of the operation surface due to the second raising element of the non-ejection activation pulse in the non-ejecting nozzle is completed. Thus, pressure loss in the pressure chamber of the ejecting nozzle side is prevented with greater certainty.

According to another aspect of the invention, there is provided a method of controlling a liquid ejecting apparatus including a liquid ejecting head that has a nozzle for ejecting liquid, a pressure chamber in communication with the nozzle, and a pressure generator of deforming an operation surface for sealing an opening surface of the pressure chamber to induce pressure fluctuation in liquid within the pressure chamber and that ejects liquid from the nozzle by activation of the pressure generator; an activation signal generator that generates an activation signal for activating the pressure generator; and a select-and-supply unit that selects an activation pulse contained in an activation signal generated by the activation signal generator and that supplies the pulse to the pressure generator. The pressure generator is configured such that, as an applied electric potential increases above a standard electric potential corresponding to a standard condition where a central portion of the operation surface is located inside of the pressure chamber from the opening surface of the pressure chamber, the central portion of the operation surface is displaced from the standard condition to further inside of the pressure chamber, and, as an applied electric potential decreases below the standard electric potential, the central portion of the operation surface is displaced from the standard condition to outside of the pressure chamber. The activation signal generator includes in the activation signal an ejection activation pulse for ejecting liquid from the nozzle, and a non-ejection activation pulse for inducing pressure fluctuation in liquid within the pressure chamber of a level such that liquid is not ejected from the nozzle. The method includes setting a minimum electric potential of the non-ejection activation pulse to no greater than a minimum electric potential of the ejection activation pulse; supplying the ejection activation pulse to a pressure generator corresponding to an ejecting nozzle ejecting liquid, and supplying the non-ejection activation pulse at least to the pressure generator corresponding to the non-ejecting nozzle located adjacent to the ejecting nozzle.

BRIEF DESCRIPTION OF THE DRAWINGS

The invention will be described with reference to the accompanying drawings, wherein like numbers reference like elements.

DESCRIPTION OF EXEMPLARY EMBODIMENTS

The following describes the exemplary embodiments of the invention in reference to the attached drawings. The exemplary embodiments mentioned below are variously restricted as preferred specific examples of the invention, but the invention is not restricted to these embodiments unless expressly limited in the following descriptions. Furthermore, the following describes an ink jet printing apparatus (hereinafter, "printer") as an example of the liquid ejection apparatus of the invention.

Figure 1:
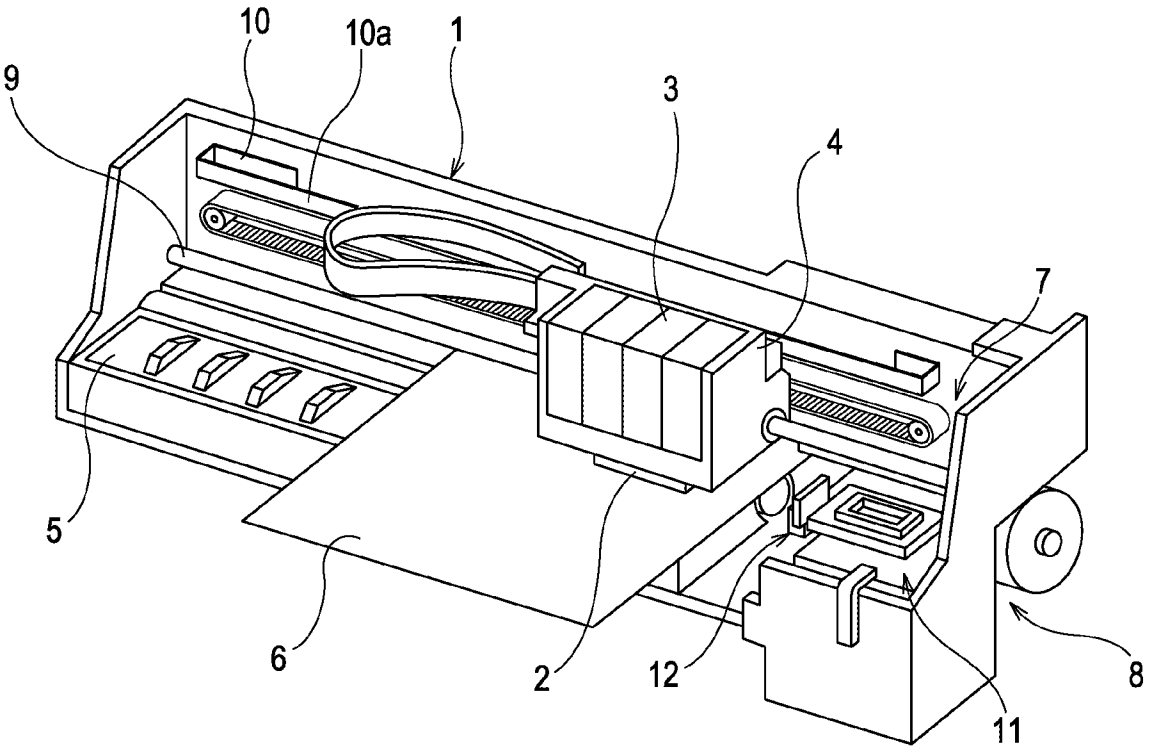
FIG. 1 is a perspective view describing a printer configuration.

FIG. 1 is a perspective view showing a configuration of a printer 1. The printer 1 is schematically configured so as to include: a carriage 4 mounted with a print head 2, being a type of liquid ejecting head, and detachably mounted with an ink cartridge 3, being a type of liquid supply source; a platen 5 provided below the print head 2 during printing operation; a carriage transfer mechanism 7 for reciprocating the carriage 4 in a width direction of printing paper 6 (a type of printing medium and object of ejection), that is to say, in a main scanning direction; and a paper feeding mechanism 8 for transporting the printing paper 6 in a sub-scanning direction perpendicular to the main scanning direction.

The carriage 4 is mounted so as to be coaxially supported on a guide rod 9 installed along the main scanning direction, and is configured so as to move along the guide rod 9 in the main scanning direction by motion of the carriage transfer mechanism 7. A position of the carriage 4 in the main scanning direction is detected by a linear encoder 10, and a detection signal, that is to say, an encoder pulse (a type of positional information), thereof is sent to a control unit 37 of a printer controller 31 (see FIG. 4). The linear encoder 10 is a type of positional information output means, outputting an encoder pulse corresponding to a scanning position of the print head 2 as positional information in the main scanning direction. The control unit 37 recognizes a scanning position of the print head 2 mounted on the carriage 4 according to a received encoder pulse. In other words, a position of the carriage 4 can be recognized, for example, by counting a received encoder pulse. Accordingly, the control unit 37 controls printing operation by the print head 2, while recognizing a scanning position of the carriage 4 (print head 2) based on an encoder pulse from the linear encoder 10.

A home position that acts as a scanning base point of the carriage is set at an end region within moving range of the carriage 4 outside of a printing region. A capping member 11 for sealing a nozzle forming surface (nozzle plate 29: see FIG. 3) of the print head 2, and a wiping member 12 for wiping the nozzle forming surface are arranged on the home position according to the embodiment. The printer 1 is configured to enable the so-called two-directional printing of letters, images and others in both directions on the printing paper 6, during an outward movement where the carriage 4 moves from the home position toward an end on an opposite side, and during an inward movement where the carriage 4 returns from the end on the opposite side to the home position.

Figure 2:
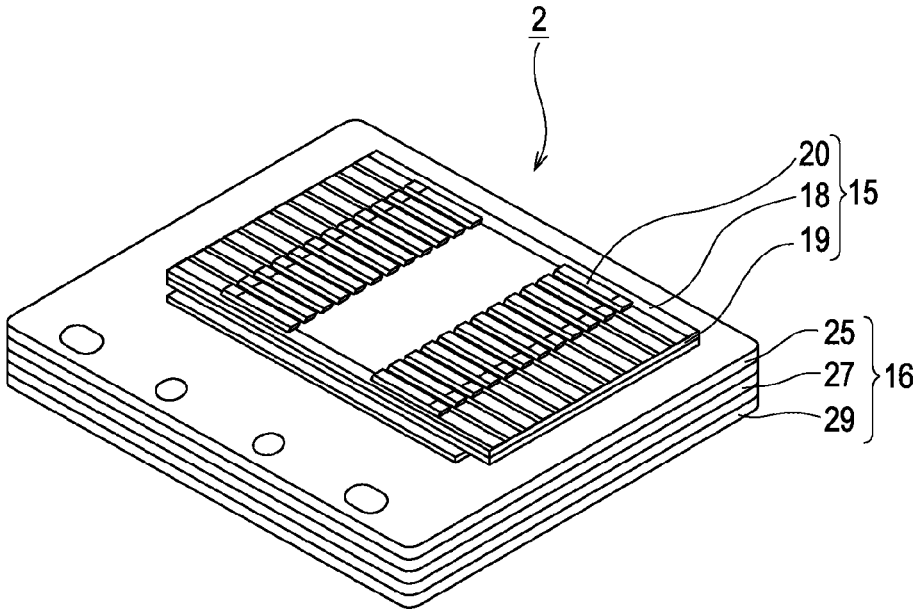
FIG. 2 is a perspective view describing a print head configuration.
Figure 3:
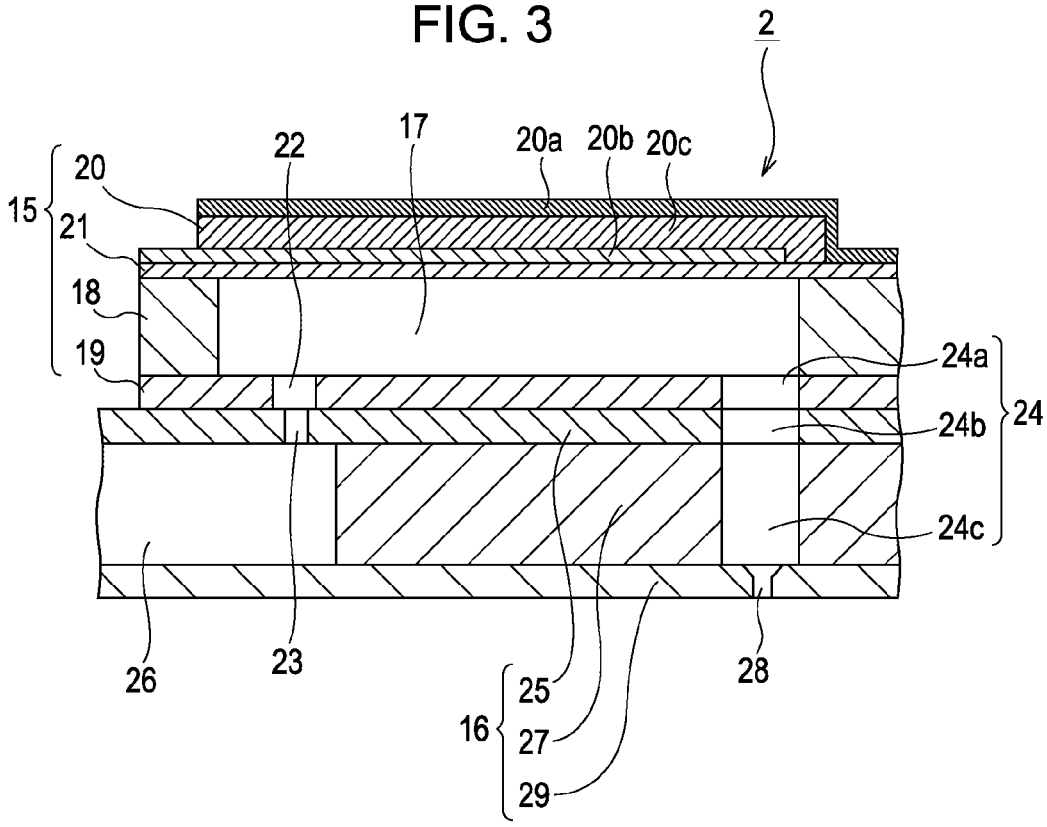
FIG. 3 is a partially sectional view of a print head.

As shown in FIGS. 2 and 3, the print head 2 includes a pressure generating unit 15 and a flow path unit 16, and these are integrated in an overlaid state. The pressure generating unit 15 is integrally formed through, for example, calcination by layering a pressure chamber plate 18 for dividing a pressure chamber 17, a communication port plate 19 provided with a supply-side communication port 22 and a first communication port 24*a*, and a vibration plate 21 equipped with a piezoelectric element 20. Furthermore, the flow path unit 16 is formed in a layered state by bonding plate members including a supply port plate 25 formed with a supply port 23 and a second communication port 24*b*, a reservoir plate 27 formed with a reservoir 26 and a third communication port 24*c*, and a nozzle plate 29 wherein a nozzle 28 is formed. The nozzle plate 29 is provided with a plurality (e.g. 360) of the nozzles 28 forming a nozzle array. The nozzle array may be provided, for example, for each color of ink.

The piezoelectric element 20 corresponding to each of the pressure chambers 17 is located on an outside surface of the vibration plate 21, forming an opposite side with the pressure chamber 17. The piezoelectric element 20 exemplified is a piezoelectric element of a so-called bending vibration mode and includes an activation electrode 20*a*, a common electrode 20*b*, and a piezoelectric material 20*c* interposed therebetween. When an activation signal (activation pulse) is applied to the activation electrode of the piezoelectric element 20, an electrical field is generated between the activation electrode 20*a* and the common electrode 20*b* corresponding to the difference in electric potential. The electrical field is imparted to the piezoelectric material 20*c*, and the piezoelectric material 20*c* deforms in response to the electrical field strength imparted. In other words, as the electric potential of the activation electrode 20*a* increases, a central portion of the piezoelectric material layer 20*c* in a width direction (nozzle array direction) bends toward the inside of the pressure chamber 17 (side proximal to the nozzle plate 29), deforming the vibration plate 21 such that a capacity of the pressure chamber 17 decreases. On the other hand, as the electric potential of the activation electrode 20*a* decreases (as it approaches 0), the central portion of the piezoelectric material layer 20*c* in a short length direction bends toward the outside of the pressure chamber 17 (side distal from the nozzle plate 29), deforming the vibration plate 21 such that the capacity of the pressure chamber 17 increases. Here, in the vibration plate 21, a portion sealing an opening of the pressure chamber 17 functions as an operation surface in the invention. A surface area of the operation surface is slightly wider than an opening surface area of the pressure chamber 17 to be sealed by the operation surface. This enables the operation surface to deform toward the inside or outside more easily from the opening surface of the pressure chamber 17. Details on movement of the operation surface of the vibration plate 21 due to deformation of the piezoelectric element 20 are discussed later using the sectional views of FIGS. 6A to 6C.

Figure 4:
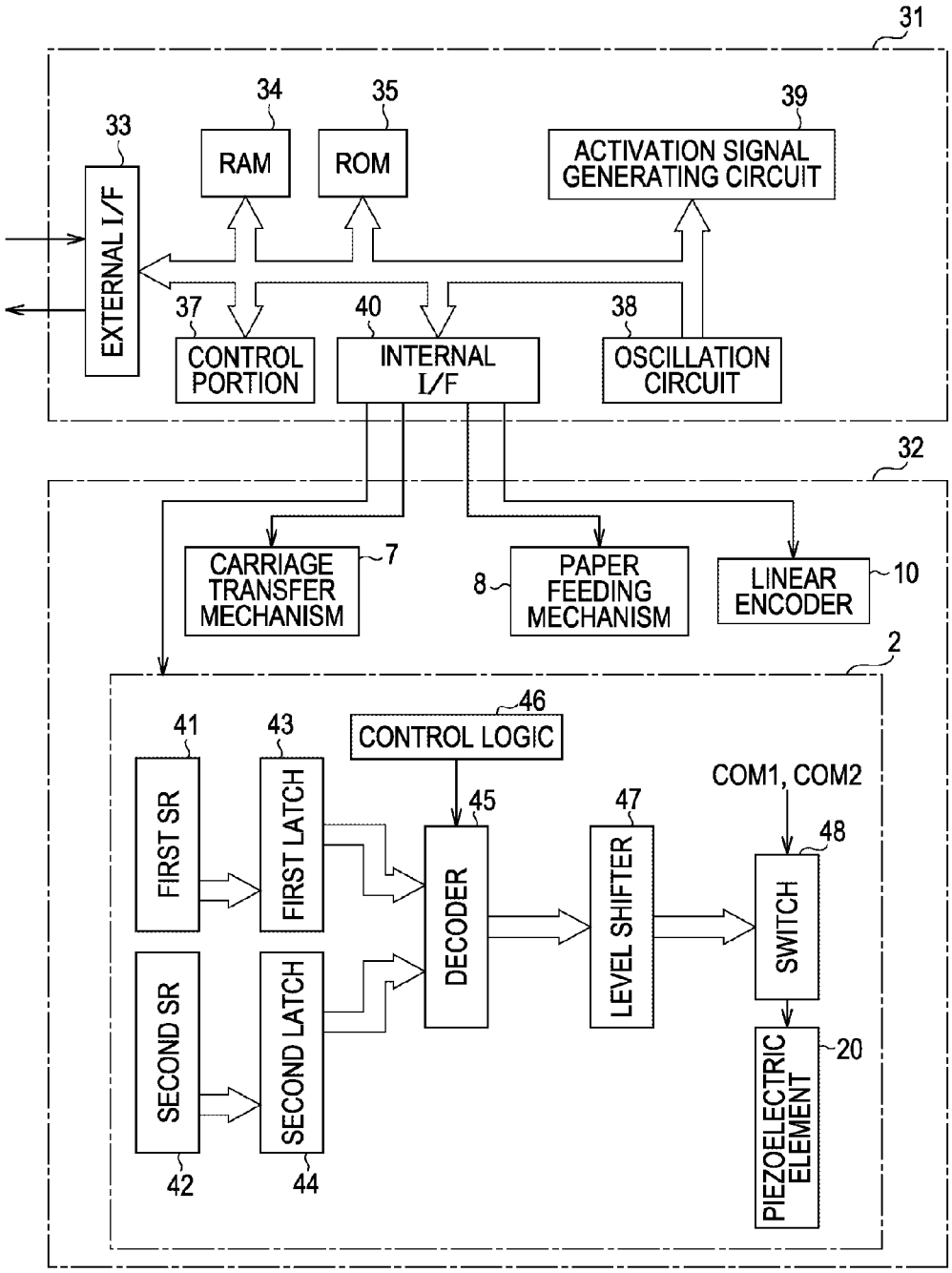
FIG. 4 is a block diagram describing an electrical configuration of a print head.

FIG. 4 is a block diagram showing an electrical configuration of the printer 1. The printer 1 according to the embodiment is schematically configured with a printer controller 31 and a print engine 32. The printer controller 31 includes an external interface (external I/F) 33 to which print data is input from an external apparatus such as a host computer, a RAM 34 in which each type of data is stored, a ROM 35 in which control programs are stored for each type of control, the control unit 37 which performs integrated control of each unit in accordance with the control programs stored in the ROM 35, an oscillating circuit 38 which generates a clock signal, an activation signal generating circuit 39 (a type of activation signal generating means) which generates an activation signal provided to the print head 2, and an internal interface (internal I/F) 40 for inputting to the print head 2 data such as dot pattern data obtained by expanding print data for each dot and an activation signal. Furthermore, the print engine 32 includes the print head 2, the carriage transfer mechanism 7, the paper feeding mechanism 8, and the linear encoder 10.

Figure 5:
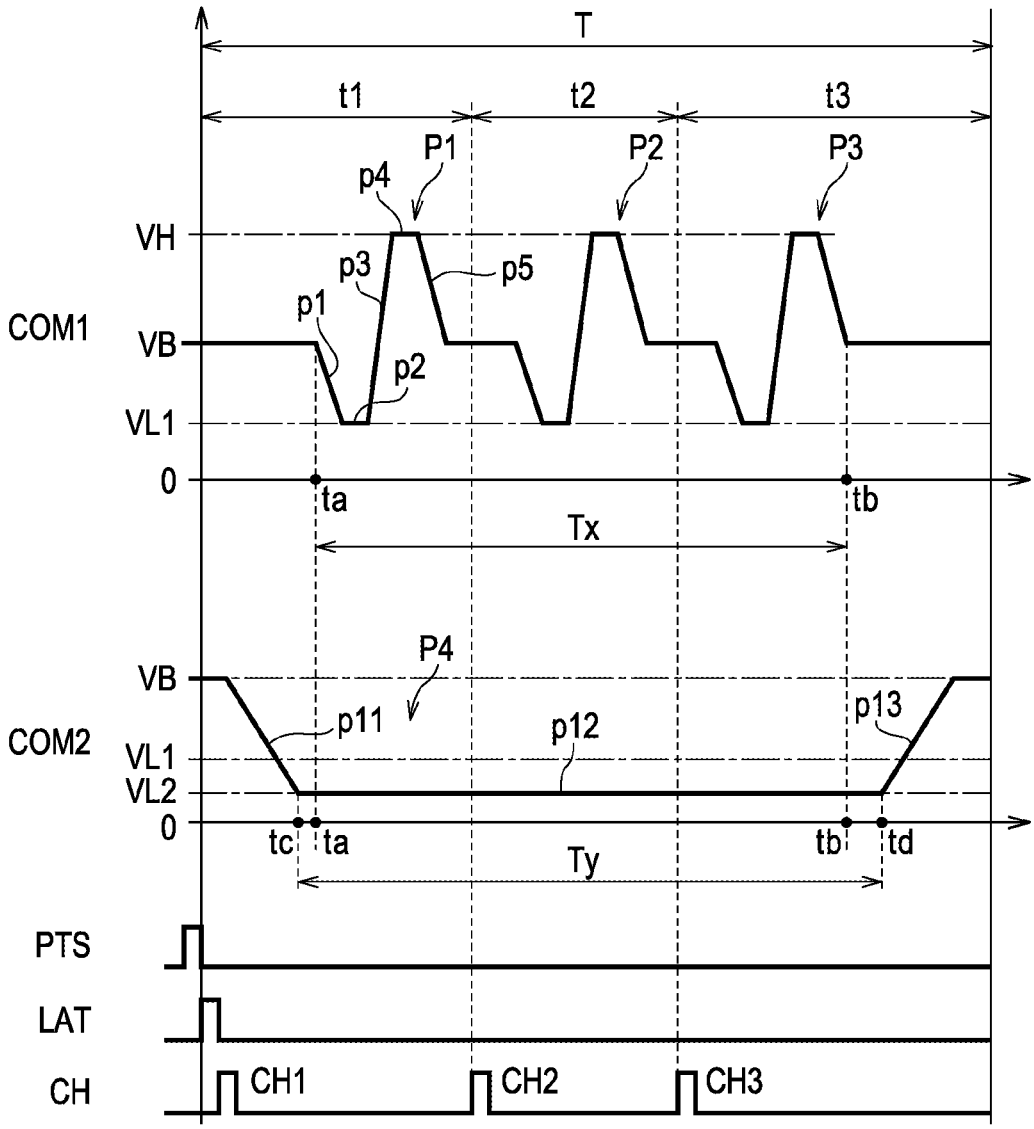
FIG. 5 is a waveform chart describing an activation signal configuration.

The control unit 37 functions as timing pulse generating means that generates a timing pulse PTS from an encoder pulse output from the linear encoder 10 (see FIG. 5). The timing pulse PTS is a signal that determines generation commencement timing of an activation signal generated by the activation signal generating circuit 39. Therefore, the activation signal generating circuit 39 outputs an activation signal for each such timing pulse PTS received. Furthermore, the control unit 37 outputs a latch signal LAT that specifies latch timing of print data, and a change (or channel) signal CH that specifies selection timing of each ejection activation pulse contained in an activation signal.

The activation signal generating circuit 39 described above generates an activation signal COM containing a plurality of ejection activation pulses for each timing pulse PTS received. In other words, the activation signal generating circuit 39 repeatedly generates a plurality (two according to the embodiment) of activation signals COM in a cycle based on the timing pulse PTS described above (hereinafter, "unit cycle T").

FIG. 5 is a diagram describing an example of a configuration of a first activation signal COM1 and a second activation signal COM2 generated by the activation signal generating signal 39 according to the embodiment. In FIG. 5, the transverse axis represents time and the longitudinal axis electric potential, respectively. The first activation signal COM1, according to the embodiment, is a series of signals having three ejection activation pulses P1 to P3 within a unit cycle T. According to the embodiment, the unit cycle T of the first activation signal COM1 is divided into three periods (pulse generation periods) t1 to t3. The first ejection generation pulse P1 is generated in the period t1, the second ejection generation pulse P2 is generated in the period t2, and the third ejection generation pulse P3 is generated in the period t3. On the other hand, the second activation signal COM2, according to the embodiment, is a signal containing one micro-oscillating activation pulse P4 (a type of non-ejection activation pulse according to the invention) within the unit cycle T. Details of each of these activation pulses are discussed later.

The following is an explanation of the electrical configuration of the print head 2. As shown in FIG. 4, the print head 2 includes a shift resistor (SR) circuit composed of a first shift resistor 41 and a second shift resistor 42, a latch circuit composed of a first latch circuit 43 and a second latch circuit 44, a decoder 45, a control logic 46, a level shifter 47, a switch 48, and the piezoelectric element 20. Each of the shift resistors 41 and 42, each of the latch circuits 43 and 44, the level shifter 47, the switch 48, and the piezoelectric element 20, respectively, are provided for each nozzle 28. FIG. 4 shows a configuration for one nozzle, and configurations for other nozzles are not illustrated in the diagram.

The print head 2 performs ejection control of ink (a type of liquid) according to print data (pixel data) SI sent from the printer controller 31. According the embodiment, since the print data SI is sent in sync with the clock signal CLK to the print head 2 in order of a higher-order bit group of 2-bit print data SI and a lower-order bit group of print data SI, first the higher-order group of print data SI is set into the second shift resistor 42. When the higher-order bit group of print data SI for all of the nozzles 28 has been set into the second shift resistor 42, the higher-order group is then shifted to the first shift resistor 41. Simultaneously to this, the lower-order bit group of print data SI is set into the second shift resistor 42.

In a subsequent stage of the first shift resistor 41 the first latch circuit 43 is electrically connected, and in a subsequent stage of the second shift resistor 42 the second latch circuit 44 is electrically connected. When the latch pulse from the printer controller 31 is input to each of the latch circuits 43 and 44, the first latch circuit 43 latches the higher-order bit group of print data, and the second latch circuit 44 latches the lower-order bit group of print data. The print data (higher-order bit group and lower-order bit group) latched at the latch circuits 43 and 44, respectively, is output to a decoder 45. The decoder 45 generates pulse selection data for selecting each activation pulse contained in the activation signals COM1 and COM2 based on the higher-order bit group and the lower-order bit group of print data.

An input side of the switch 48 is supplied with the first activation signal COM1 and the second activation signal COM2 from the activation signal generating circuit 39. Furthermore, an output side of the switch 48 is connected to the piezoelectric element 20. The switch 48 selectively supplies each activation pulse contained in the activation signals COM1 and COM2 to the piezoelectric element 20 based on the pulse selection data described above. The switch 48, which operates in such a manner, functions as a type of select-and-supply means in accordance with the invention.

Each of the ejection activation pulses P1 to P3 contained in the first activation signal COM1 is composed of an expansion element p1, an expansion hold element p2, a contraction element p3, a damping hold element p4, and a damping element p5. The expansion element p1 is a waveform element, corresponding to the first dropping element according to the invention, which drops the electric potential by a fixed gradient from a midpoint potential VB (standard electric potential in the invention) corresponding to a standard capacity (capacity acting as a standard for expansion or contraction) of the pressure chamber 17 to a first expansion potential VL1 (minimum electric potential of the ejection activation pulses P1 to P3). The expansion hold element p2 is a waveform element, corresponding to the first sustaining element according to the invention, which sustains the first expansion potential VL1 that is a terminal potential of the expansion element p1. The contraction element p3 is a waveform element, corresponding to the first raising element according to the invention, which raises the electric potential at a steep gradient from the first expansion potential VL1 to a contraction potential VH. The damping hold element p4 is a waveform element which sustains the contraction potential VH for a predetermined period. Furthermore, the damping element p5 is a waveform element which restores the electric potential by a fixed gradient, of a level such that ink is not ejected, from the contraction potential VH to the midpoint potential VB.

Figure 6A:
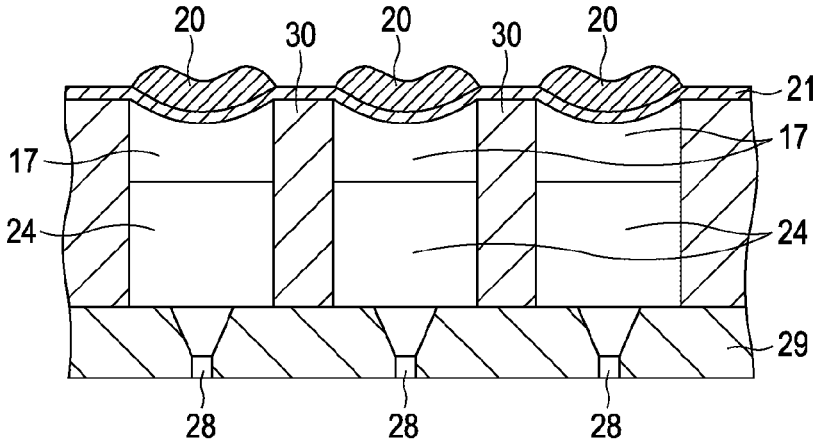
FIGS. 6A to 6C are sectional views describing a main part of a print head in a nozzle array direction.
Figure 6B:
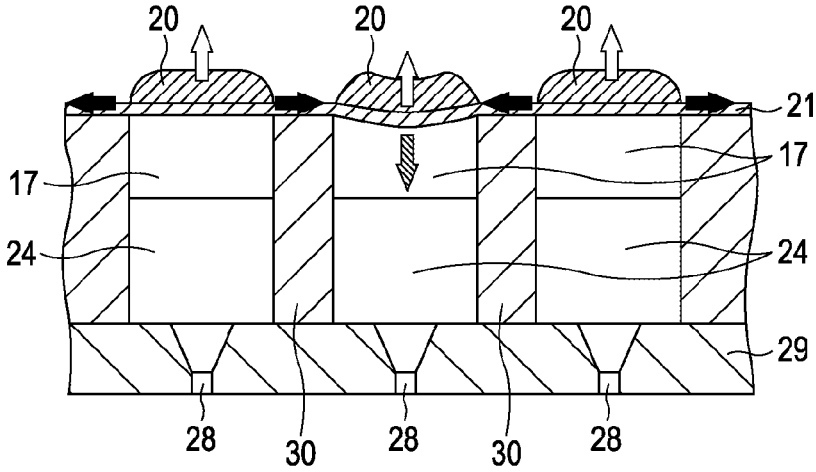
Figure 6C:
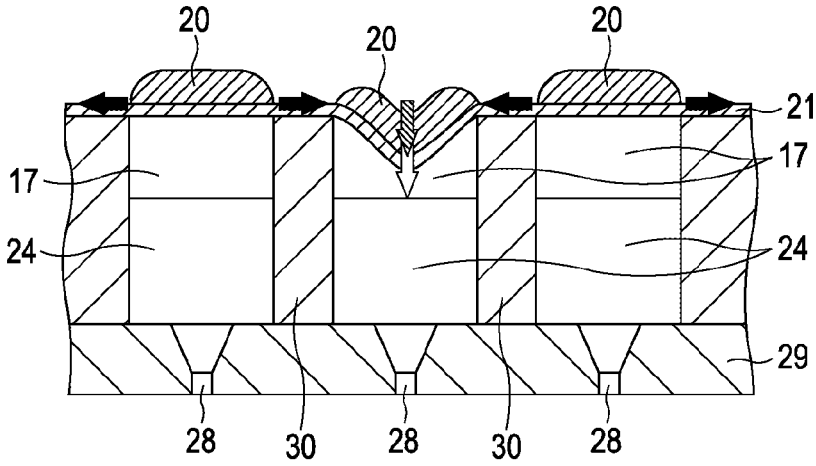

FIGS. 6A to 6C are sectional views describing a main part of the print head 2 in a nozzle array direction. The nozzle 28 at the center in each of FIGS. 6A to 6C is an ejecting nozzle ejecting ink in a certain unit cycle, and the nozzles 28 located on both sides of the ejecting nozzle are non-ejecting nozzles that do not eject ink in the same unit cycle. Some of the component members shown in the figure have been simplified.

While the midpoint potential VB is being continuously supplied to the piezoelectric element 20, as shown in FIG. 6A, a central portion of the operation surface in a width direction (nozzle array direction) is in a condition such that it is located inside of the pressure chamber 17 (nozzle plate 29 side) from an opening surface of the pressure chamber 17. Therefore, when the midpoint potential VB is supplied to the piezoelectric element 20, the central portion in a width direction of the piezoelectric element 20 is in a condition such that it is slightly bent toward the inside of the pressure chamber 17. This condition is the standard condition. While neither of the ejection activation pulses P1 to P3 of the first activation signal COM1 nor the micro-oscillating activation pulse P4 of the second activation signal COM2 are supplied to the piezoelectric element 20, the midpoint potential VB described above is continuously supplied to the piezoelectric element 20, thus resulting in the standard condition as shown in FIG. 6A, regardless of the nozzle 28 (hereinafter, "appropriate ejecting nozzle") ejecting ink within the unit cycle and the nozzles 28 (hereinafter, "appropriate non-ejecting nozzles") not ejecting ink within the same unit cycle. Hereinafter, the capacity of the pressure chamber 17 in the standard condition is called "standard capacity". The ink ejection control shown in FIGS. 6A to 6C is discussed later.

When the ejection activation pulse described above is supplied to the piezoelectric element 20, the central portion in a width direction of the operation portion of the vibration plate 21 and the piezoelectric element 20 bends toward the outside of the pressure chamber 17 (side distal from the nozzle plate 29) due to the expansion element p1. As a result, the pressure chamber 17 expands from a standard capacity corresponding to the midpoint potential VB to a first expansion capacity corresponding to the first expansion potential VL1. A meniscus in the nozzle 28 is drawn into the pressure chamber 17 side by the expansion, and within the pressure chamber 17 an ink is supplied from the reservoir 26 via the supply port. The expanded condition of the pressure chamber 17 is sustained during a supply period of the expansion hold element p2. Thereafter, the central portion of the piezoelectric element 20 and the operation portion are bent inside of the pressure chamber 17 by applying the contraction element p3. As a result, the pressure chamber 17 rapidly contracts from the first expansion capacity to the contraction capacity corresponding to the contraction potential VH. Ink is pressurized within the pressure chamber 17 by the rapid contraction of the pressure chamber 17, and a specified amount (e.g. several ng to tens of ng) of ink is ejected from the nozzle 28. A contracted condition of the pressure chamber 17 is sustained over a supply period of the damping hold element p4, during which the pressure oscillation of ink within the pressure chamber 17 generated by ejection of ink cyclically increases and decreases. The damping element p5 is supplied in time with the increasing ink pressure within the pressure chamber 17, and accordingly the central portion of the piezoelectric element 20 and the operation portion bend toward the outside of the pressure chamber 17 and return to the standard condition. As a result, the pressure chamber 17 returns to the standard capacity and the pressure fluctuation (residual vibration) of ink within the pressure chamber 17 decreases.

The second activation signal COM2 according to the embodiment functions as a type of non-ejection activation signal, and generates only a micro-oscillating activation pulse P4 within the unit cycle T. The micro-oscillating pulse P4 includes a micro-oscillating expansion element p11, micro-oscillating expansion hold element p12, and a micro-oscillating contraction element p13. The micro-oscillating expansion element p11 is a waveform element, corresponding to the second dropping element according to the invention, which drops the electric potential more sufficiently than the expansion element p1 by a gentle gradient from the midpoint potential VB corresponding to the standard capacity of the pressure chamber 17 to the second expansion potential VL2 (minimum electric potential of the micro-oscillating activation pulse P4). The micro-oscillating expansion element p11 is generated prior to the expansion element p1 of the first ejection activation pulse P1 in the same unit cycle T. As shown in FIG. 5, a terminal time point tc of the micro-oscillating expansion element p11 precedes a starting point to of the expansion element p1 of the first ejection activation pulse P1. Furthermore, the second expansion potential VL2 is set to a value no greater than the first expansion potential VL1, which is the minimum electric potential of the ejection activation pulses P1 to P3. The second expansion potential VL2 according to the embodiment is of a value of between 0 to VL1.

The micro-oscillating expansion hold element p12 is a waveform element, corresponding to the second sustaining element according to the invention, which sustains the second expansion potential VL2 that is the terminal potential of the micro-oscillating expansion element p11 for a fixed period of time. A generating time Ty of the micro-oscillating expansion hold element p12 (time from a starting end tc to a terminal end td), according to the embodiment, is set longer than a time Tx from the starting end of the first ejection activation pulse P1 (starting end of the expansion element p1) to the terminal end of the third ejection activation pulse P3 (terminal end of the damping element p5) in the first activation signal COM1. Furthermore, the micro-oscillating contraction element p13 is a waveform element, corresponding to the second raising element according to the invention, which sufficiently raises the electric potential to a level such that ink is not ejected from the nozzle 28 by a gentle gradient from the second expansion potential VL2 to the midpoint potential VB. The micro-oscillating contraction element p13 is generated subsequent to the damping element p5 of the third ejection activation pulse P3 in the same unit cycle T. Consequently, as shown in FIG. 5, the starting end td of the micro-oscillating contraction element p13 is subsequent to the terminal point tb of the damping element p5 of the third ejection activation pulse P3.

When the micro-oscillating activation pulse P4 configured as described above is provided to the piezoelectric element 20, first the central portion in a width direction of the operation portion of the piezoelectric element 20 and the vibration plate 21 bends toward the outside of the pressure chamber 17 due to the micro-oscillating contraction element p11. This causes the pressure chamber 17 to expand from the standard capacity corresponding to the midpoint potential VB to the second expansion capacity corresponding to the second expansion potential VL2. The second expansion capacity according to the embodiment is larger than the first expansion capacity described above. A meniscus in the nozzle 28 is drawn into the pressure chamber 17 side by the expansion, and within the pressure chamber 17 ink is supplied from the reservoir 26 via the supply port. The expanded state of the pressure chamber 17 is sustained during the supply period of the micro-oscillating expansion hold element p12. As mentioned above, since the time Ty of the micro-oscillating expansion hold element p12 is sufficiently long, vibration of ink previously generated according to the expansion of the pressure chamber 17 caused by the micro-oscillating expansion element p11 is mostly converged. Following this, the micro-oscillating contraction element p13 is applied, thereby causing the central portion of the piezoelectric element 20 and the operation portion to bend toward the inside of the pressure chamber 17 and return to the standard condition. As a result, the pressure chamber 17 returns to the standard capacity and the residual vibration of ink within the pressure chamber 17 decreases. In the pressure chamber 17, according to a series of capacity fluctuations of the pressure chamber 17, comparatively gentle pressure fluctuation is generated, and a meniscus exposed in the nozzle 28 micro-oscillates due to the pressure fluctuation. Thickening ink in the vicinity of the nozzle 28 is diffused by the micro-oscillation of the meniscus, and as a result, thickening of ink can be prevented.

The following describes the printing control (ejection control), using the activation signals COM1 and COM2 described above, in reference to FIGS. 6A to 6C.

The printing control according to the embodiment is configured such that any one or a plurality of the ejection activation pulses P1 to P3 of the first activation signal COM1 is supplied in respect to the piezoelectric element 20 corresponding to the nozzle 28 performing ejection of ink (ejecting nozzle) in a certain unit cycle T. Further, the micro-oscillating pulse P4 of the second activation signal COM2 is applied to the piezoelectric element 20 corresponding to the nozzle 28 not performing ejection of ink ("non-ejecting nozzle") in the unit cycle T. More specifically, when forming a large dot in a predetermined position of a printing medium, three of the ejection activation pulses P1 to P3 within the unit cycle T are sequentially applied to the piezoelectric element 20 of the ejection nozzle, and thereby ink is ejected three successive times from the nozzle. Furthermore, when forming a medium dot, two of the ejection activation pulses P1 and P3 within the unit cycle T are sequentially applied to the piezoelectric element 20 of the ejection nozzle, and thereby ink is ejected two successive times from the nozzle. Additionally, when forming a small dot, one of the ejection activation pulse P2 within the unit cycle T is applied to the piezoelectric element 20 of the ejection nozzle, and thereby ink is ejected from the nozzle. When not printing, and where none of the dots are formed, the micro-oscillating activation pulse P4 of the second activation signal COM2 is applied to the piezoelectric element 20 of the non-ejecting nozzle, and thereby the meniscus in the non-ejecting nozzle micro-oscillates at a level such that ink is not ejected. As a result, the print data according to the embodiment is capable of printing in four gradation sequences of "large dot", "medium dot", "small dot" and "non-printing". The following exemplifies when ink corresponding to the small dot is ejected from the nozzle 28 at the center in FIGS. 6A to 6C within the unit cycle T, while ink is not ejected from the nozzles 28 on both sides of the ejecting nozzle. In the following example, in other words, the nozzle 28 at the center is the ejecting nozzle, and the nozzles 28 located on both sides of the ejecting nozzle, respectively, are non-ejecting nozzles.

While neither of the ejection activation pulses P1 to P3 of the first activation signal COM1 nor the micro-oscillating activation pulse P4 of the second activation signal COM2 are applied to the piezoelectric element 20, the midpoint potential VB described above is continuously supplied to the piezoelectric element 20, thus resulting in the standard condition shown in FIG. 6A, regardless of the ejecting nozzle and the non-ejecting nozzles. As mentioned above, the standard condition is a condition wherein the central portion in the width direction of the operation surface is located inside of the pressure chamber 17 from the opening surface of the pressure chamber 17. In the standard condition, the pressure within the pressure chambers 17 corresponding to each of the nozzles 28 are the same level.

Next, the micro-oscillating expansion element p11 of the micro-oscillating activation pulse P4 is supplied to the piezoelectric elements 20 of the non-ejecting nozzles. As shown by hollow arrows in FIG. 6B, this causes the central portion in the width direction of the operation portion of the vibration plate 21 and the piezoelectric element 20 corresponding to the non-ejecting nozzles to bend to a degree so as to become the same surface as the opening surface of the pressure chamber 17 (or a degree located slightly outside). As such, the operation surface bends toward a vicinity of the opening surface of the pressure chamber 17, and thereby the operation surface becomes a shape that projects in the nozzle array direction in respect to the partitions 30 dividing the pressure chamber 17 on both sides. As shown by black arrows in FIG. 6B, this results in a condition where the partition walls 30 are pushed toward the adjoining pressure chamber 17 sides, respectively, due to the operation surface. As a result of being pushed, a downward (nozzle 28 side) force is exerted on the operation surface at the ejecting nozzle, as shown by a hatched arrow in FIG. 6B. The pushed condition is sustained over the supply period Ty of the micro-oscillating expansion hold element p12 of the micro-oscillating activation pulse P4. In the terminal time point of the micro-oscillating expansion element p11, the piezoelectric element 20 and the operation portion of the vibration plate 21 of the ejecting nozzle remains in the standard condition shown in FIG. 6A.

Next, the expansion element p1 of the second ejection activation pulse P2 is applied to the piezoelectric element 20 corresponding to the ejection nozzle in period t2, in a condition where the pushed condition of the partition 30 is sustained due to the operation surface in the non-ejecting nozzles (in other words, a condition where the micro-oscillating expansion hold element p12 is continuously being applied to the piezoelectric element 20 corresponding to the non-ejecting nozzles). The central portion in the width direction of the operation portion of the vibration plate 21 and the piezoelectric element 20 corresponding to the ejecting nozzle bends toward the vicinity of the opening surface of the pressure chamber 17 (slightly inside from the opening surface), as shown by the hollow arrows in FIG. 6B. As a result, the pressure chamber 17 expands from the standard capacity corresponding to the midpoint potential VB to the first expansion capacity corresponding to the first expansion potential VL1. Here, if the first expansion potential VL1 and the second expansion potential VL2 are the same values, the amount of bending of the operation portion (amount of displacement toward the outside of the pressure chamber) is also the same level. In this case, the pushing force that the partition 30 receives from the operation surface of both sides thereof results in a nearly equally counterbalanced state. According to the embodiment, on the contrary, the second expansion potential VL2 is set to a value lower than the first expansion potential VL1, and thus the amount of bending toward the outside of the pressure chamber of the operation portion corresponding to the non-ejecting nozzles is greater than the amount of bending of the operation portion corresponding to the ejecting nozzle. Therefore, in respect to the partitions 30 between the pressure chambers 17 corresponding to the non-ejecting nozzles and the pressure chamber 17 corresponding to the ejecting nozzle, the pushing force received from the operation surface at the non-ejecting nozzle is greater than the pushing force received from the operation surface at the ejecting nozzle. Consequently, even in the condition where a portion of the operation surface corresponding to the ejecting nozzle is bent to a maximum limit toward the outside of the pressure chamber 17, the partitions 30 dividing the pressure chambers 17 are sustained in a condition so as to be pressed toward the inside by a portion of the operation surface at the non-ejecting nozzle. As such, the downward force continues to be applied to the operation surface at the ejecting nozzle.

Subsequent to the expanded condition of the pressure chamber 17 in the ejecting nozzle being sustained during a supply period of the expansion hold element p2 of the second ejection activation pulse P2, the contraction element p3 of the second ejection activation pulse P2 is applied, and thereby the central portion of the piezoelectric element 20 and the operation portion in the ejecting nozzle rapidly bends toward the inside (down side) of the pressure chamber 17, as shown by a hollow arrow in FIG. 6C. This results in the pressure chamber 17 rapidly contracting from the first expansion capacity to the contraction capacity corresponding to the contraction potential VH. The pressure in the pressure chamber 17 rapidly rises due to the rapid contraction of the pressure chamber 17, and due to this, a specified amount (e.g. several ng to tens of ng) of ink is ejected from the nozzle 28. When this occurs, the partitions 30 dividing the pressure chamber 17 corresponding to the ejecting nozzle are pushed inward by the operation surface at the non-ejecting nozzle, and thus, even if the internal pressure of the pressure chamber 17 rises, deforming (bending) of the partitions 30 toward the non-ejecting nozzle is suppressed. Due to this, pressure loss from the pressure chamber 17 of the ejecting nozzle to the pressure chamber 17 of the non-ejecting nozzles can be reduced. As a result, variation of ejection characteristics, such as the velocity of ejected ink and ink amount, is suppressed regardless of whether ejection is performed simultaneously by nozzle 28 adjacent to the ejecting nozzle (whether the nozzle located next to the ejecting nozzle is an ejecting nozzle), or whether ejection is not performed simultaneously by nozzle 28 adjacent to the ejecting nozzle (whether the nozzle next to the ejecting nozzle is a non-ejecting nozzle). In other words, crosstalk occurring between adjacent nozzles is prevented.

Furthermore, since the piezoelectric elements 20 corresponding to all of the nozzles 28 activate and pressure fluctuation occurs within the pressure chambers 17, regardless of the ejection/non-ejection of ink at any period in the unit period T, it is possible to also reduce pressure loss toward the pressure chambers of the non-ejecting nozzles through the reservoir 26, and this factor also contributes toward the prevention of crosstalk. Additionally, according to the embodiment, the second expansion potential VL2 is set to a value no greater than the first expansion potential VL1 that is the minimum electric potential of the ejection activation pulse, and thus, even if the inner pressure of the pressure chamber 17 of the ejecting nozzle increases, deforming of the partitions 30 dividing the pressure chamber 17 toward the non-ejecting nozzles is more reliably suppressed. This enables pressure loss to be more effectively suppressed.

The contracted condition of the pressure chamber 17 of the ejecting nozzle is sustained during the supply period of the damping hold element p4 of the second ejection activation pulse P2, and subsequently the central portion of the piezoelectric element 20 and the operation portion return to the standard condition, also due to the supply of the damping element p5 of the second ejection activation pulse P2. This causes the pressure chamber 17 to return to the standard capacity and the pressure fluctuation (residual vibration) of ink within the pressure chamber 17 to be reduced. Meanwhile, after the passage of the supply period Ty of the micro-oscillating expansion hold element p12, the micro-oscillating contraction element p13 of the micro-oscillating activation pulse P4 is applied to the piezoelectric element 20 of the non-ejecting nozzle, thereby causing the central portion of the piezoelectric element 20 and the operation portion to bend toward the inside of the pressure chamber 17 and return to the standard condition.

According to the embodiment, the micro-oscillating expansion element p11 of the micro-oscillating activation pulse P4 is generated prior to the expansion element p1 of the ejection activation pulse (the first ejection activation pulse P1 leading in the unit cycle T) of the same unit cycle T, and, further, the micro-oscillating expansion element p13 of the micro-oscillating activation pulse P4 is generated subsequent to the contraction element p3 of the ejection activation pulse (the third ejection activation pulse P3 concluding in the unit cycle T) of the same unit cycle T. Therefore, since deformation from the standard condition of the operation surface toward the outside of the pressure chamber due to the micro-oscillating expansion element p11 of the micro-oscillating activation pulse P4 in the non-ejecting nozzles is concluded prior to ejection activation commencing due to the ejection activation pulse in at least the ejecting nozzle, and returning to the standard condition of the operation surface due to the micro-oscillating contraction element p13 of the micro-oscillating activation pulse P4 in the non-ejecting nozzles is concluded subsequent to ink being ejected due to the ejection activation pulse in at least the ejecting nozzle, pressure loss in the pressure chamber 17 of the ejecting nozzle is more reliably prevented.

A case where a line is printed on a printing medium, such as the printing paper 6 in the printer 1 described above, is explained here.

Figure 7:
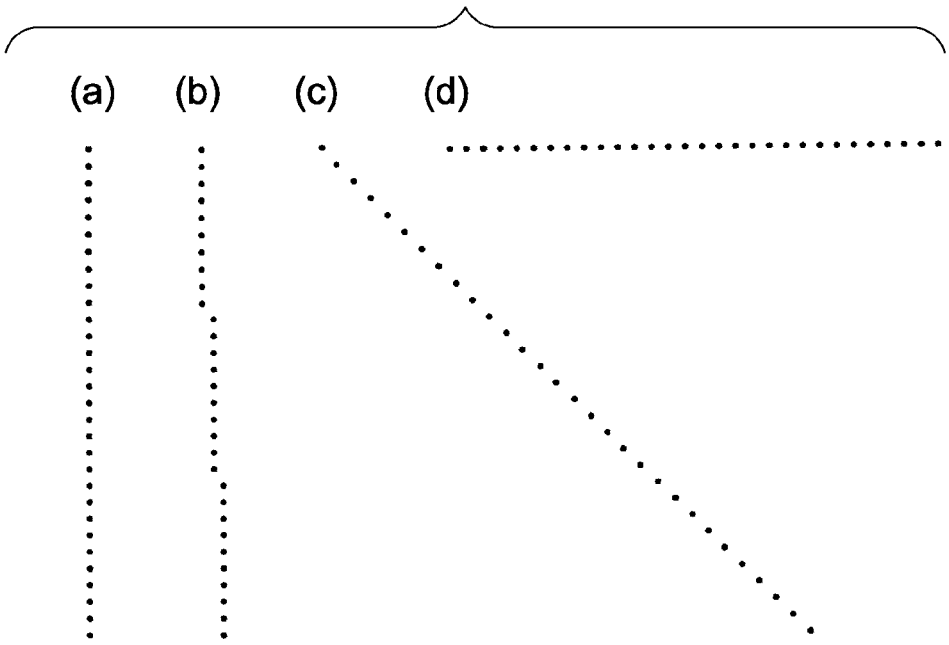
FIG. 7 is a schematic view describing each type of line.
Figure 8:
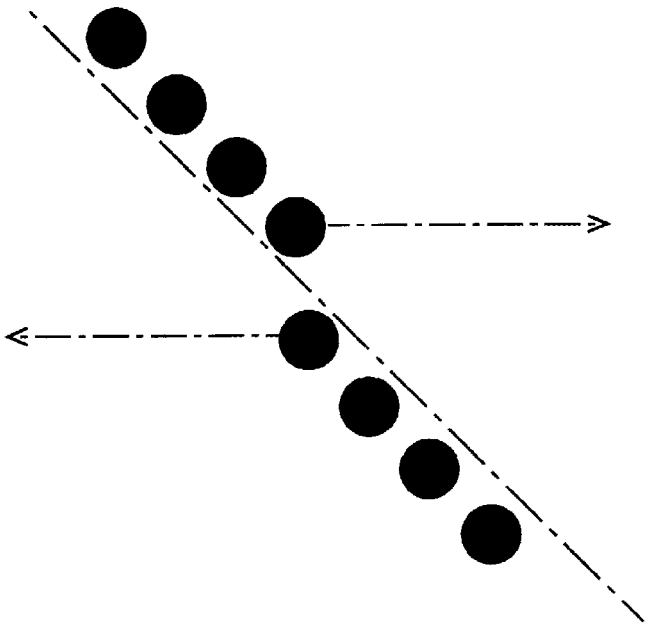
FIG. 8 is a schematic view describing a joint of an oblique line in an enlarged manner.

FIG. 7 is a schematic view showing an example of a line formed on the printing medium, wherein part (a) shows a longitudinal line of 0°, part (b) an oblique line of 6°, part (c) an oblique line of 45°, and part (d) a transverse line of 90°, respectively. Furthermore, FIG. 8 is an expanded schematic view describing a joint of the oblique line of 45°.

Adopting a parallel longitudinal line angle of 0° in the subscanning direction and a parallel transverse line angle of 90° in the main scanning direction in the so-called printer 1 capable of two-directional printing, the transverse line of 90° can be formed by successively ejecting ink from a nozzle 28 at intervals corresponding to the printing density, and lining up dots landing linearly in a head scanning direction. Furthermore, the longitudinal line angle of 0° can be formed by simultaneously ejecting ink from a plurality of adjacent nozzles 28, and lining up dots landing linearly in a subscanning direction. Additionally, an oblique line can be formed by ejecting ink while sequentially staggering the ejection timing of each nozzle at intervals corresponding to the printing density.

However, in the case of printing a longitudinal line of a length no less than the nozzle array, first ink is ejected from each of the nozzles 28 in a first pass (outward scanning pass), thereby forming a dot group in predetermined positions on the printing medium to print part of the line, and after the printing medium has been transported exactly the length of the nozzle array in the subscanning direction, ink is then ejected from each of the nozzles 28 in a second pass (inward scanning pass), forming the next dot group so as to continue on from the previously formed dot group. By means of such multiple passes, each variety of line can be formed by lining up dots landed linearly at a predetermined printing density.

When ink is ejected while scanning the printing medium with the print head 2, ink is ejected from the nozzle 28 in an oblique direction in respect to the printing surface of the printing medium. In other words, it is necessary to take this factor into consideration by adjusting the ejection timing so as to ensure uniformity of the locations of ink landed at both the outward pass and inward pass. For example, in the case of forming the longitudinal line shown in part (a) of FIG. 7, it is conceivable to adjust the ejection timing such that the locations of ink landed at the outward pass and inward pass match. Therefore, the ejection timing in the outward and inward scanning passes is adjusted such that the outward and inward pass landing locations match when ink is simultaneously ejected from all (or a majority) of the nozzles forming the nozzle array (so-called "when all on"). When printing the longitudinal line with multiple passes, this enables a line to be formed without a break or discontinuity such that the joints of dot groups including the line (so-called "band joints") line up linearly in the subscanning direction.

However, unless crosstalk between adjacent nozzles is taken into consideration, the velocity of ejected ink changes depending on whether ink is simultaneously ejected from a plurality of adjacent nozzles 28 (when all on), or whether ink is individually ejected from a nozzle 28 (when one on). As such, the positions of ink landed in the main scanning direction also differ. Therefore, when the ejection timing of the outward path has been adjusted so as to ensure uniformity of the ink landing positions when all on, since the less the number of simultaneously ejecting nozzles 28 there are, the lower the velocity of ejected ink, this causes offsetting in the ink landing positions. For example, when forming the oblique line 45° shown in part (c) of FIG. 7, due to the timing with which the respective dots are formed, the velocity of ejected ink is reduced compared to when all on, since each nozzle 28 is one on. When the velocity of ejected ink is reduced, since the time till landing on the printing medium becomes proportionately longer, there is a tendency for the position of landed ink to be offset on a leading side of the head movement direction. As such, taking the left-to-right direction as being the scanning direction of the outward path and the right-to-left direction as being the scanning direction of the inward path in FIG. 8, in respect to the theoretical oblique line of 45° shown by a dashed line (theoretical line showing the ideal ink landing positions), in the outward path ink lands at an offset to the right side and in the inward path lands at an offset to the left side as shown by arrows. In this manner, there is a problem of ink landing position offsetting of the dots occurring at a joint of a line, visually giving an impression of discontinuity. Similarly, when forming an oblique line of 45° where the timing has been adjusted so as to ensure uniformity of the outward and inward ink landing positions when one on, each ink linearly lands on the theoretical line of 45° even at the outward and inward joints. However, when printing a longitudinal line of 0°, for example, in this case, since the velocity of ejected ink increases compared to when one on, the landing positions of ink tend to be offset rearward in the head movement direction. As a result, landing position offsetting occurs at the joint of the longitudinal line, and printing quality decreases. Regarding this factor, where the invention has been applied, since the ejection characteristics of ink are uniform regardless of the number of simultaneously ejecting nozzles 28, landing position offsetting at a joint of a line is prevented, and printing quality improved.

The invention is not limited by the above-described embodiment, and various modifications are possible in accordance with the descriptions of the scope of the claims.

According to the first embodiment described above, for example, a configuration is exemplified wherein three pulses from the first ejection activation pulse P1 to the third ejection activation pulse P3 are contained in the first activation signal COM1, but it is not limited to this, and it may be a configuration wherein at least one ejection activation pulse is contained. Furthermore, the waveform of the ejection activation pulses P1 to P3 are exemplified as all being of the same configuration, but ejection activation pulses of various waveforms can be employed. In this case, the second expansion potential VL2 of the micro-oscillating activation pulse P4 is preferably no greater than the minimum electric potential of all the ejection activation pulses.

Furthermore, according to the first embodiment described above, the micro-oscillating activation pulse P4 is exemplified as a non-ejection activation pulse in the invention, but the non-ejection activation pulse may not necessarily have a micro-oscillating function.

Additionally, according to the first embodiment described above, a configuration is exemplified wherein the micro-oscillating activation pulse P4, which is the non-ejection activation pulse, is applied to the piezoelectric elements 20 corresponding to all of the non-ejecting nozzles, but it is not limited to this, and a similar use effect to the above-described embodiment can be expected where the micro-oscillating activation pulse P4 is applied to the piezoelectric element 20 corresponding to the non-ejecting nozzles adjacent to an ejecting nozzle.

Figure 9:
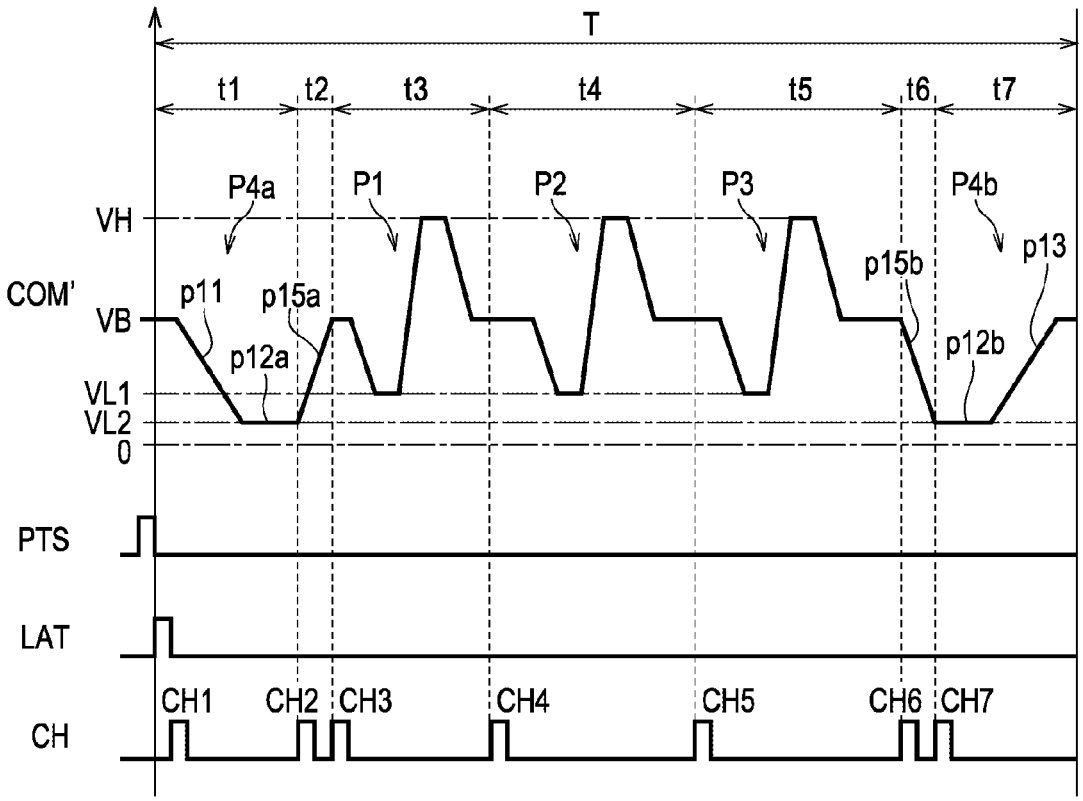
FIG. 9 is a waveform chart describing an activation signal configuration according to a second embodiment.

FIG. 9 is a waveform chart describing an activation signal configuration according to a second embodiment of the invention.

According to the first embodiment described above, a configuration is exemplified wherein the ejection activation pulse is contained in the first activation signal COM1, and the micro-oscillating activation pulse is contained in the second activation signal COM2, but it is not limited to this. The second embodiment differs from the first embodiment described above in that both the ejection activation pulse and the micro-oscillating activation pulse are contained in a single activation signal COM'.

In the activation signal COM' according to the embodiment, the unit cycle T is divided into a total of seven periods, t1 to t7. A front stage portion P4*a* of the micro-oscillating activation pulse P4 is produced in the period t1, a front side connecting element p15*a* is produced in the period t2, and the first ejection activation pulse P1 is produced in the period t3. Furthermore, the second ejection activation pulse P2 is produced in the period t4, the third ejection activation pulse P3 is produced in the period t5, and a rear side connecting element p15*b* is produced in the period t6. A rear stage portion P4*b* of the micro-oscillating activation pulse P4 is produced in the period t7. The front side connecting element p15*a* and the rear side connecting element p15*b* are waveform elements that are not applied to the piezoelectric element 20. The front stage portion P4*a* includes the micro-oscillating expansion element p11 that drops from the standard potential VB to the second expansion potential VL2, and a front side expansion hold element p12*a* that sustains the second expansion potential VL2 for a certain period of time. The rear stage portion P4*b* includes a rear side expansion hold element p12*b* that sustains the second expansion potential VL2 for a certain period of time, and the micro-oscillating contraction element p13 that rises from the second expansion potential VL2 to the standard potential VB. In the same manner as in the first embodiment described above, the second expansion potential VL2 is set to a value no greater than the first expansion potential VL1 that is the minimum electric potential of the ejection activation pulses P1 to P3.

Since the printing control according to the second embodiment is the same as for the first embodiment described above in regards to one or a plurality of ejection activation pulses P1 to P3 being supplied to the piezoelectric element 20 corresponding to the ejecting nozzle, the description thereof will be omitted here. The second embodiment is configured such that after the front stage portion P4*a* of the period t1 has been selected and applied to the piezoelectric element 20 corresponding to the non-ejecting nozzle, the rear stage portion P4*b* of the period t7 is selected and applied. The combination of the front stage portion P4*a* and the rear stage portion P4*b* achieves the same use effect as the micro-oscillating activation pulse P4 of the first embodiment described above. Therefore, by means of the configuration according to the second embodiment, the same effect as in the first embodiment described above is achieved. In other words, pressure loss during ink ejection in an ejecting nozzle can be reduced and crosstalk prevented.

Figure 10:
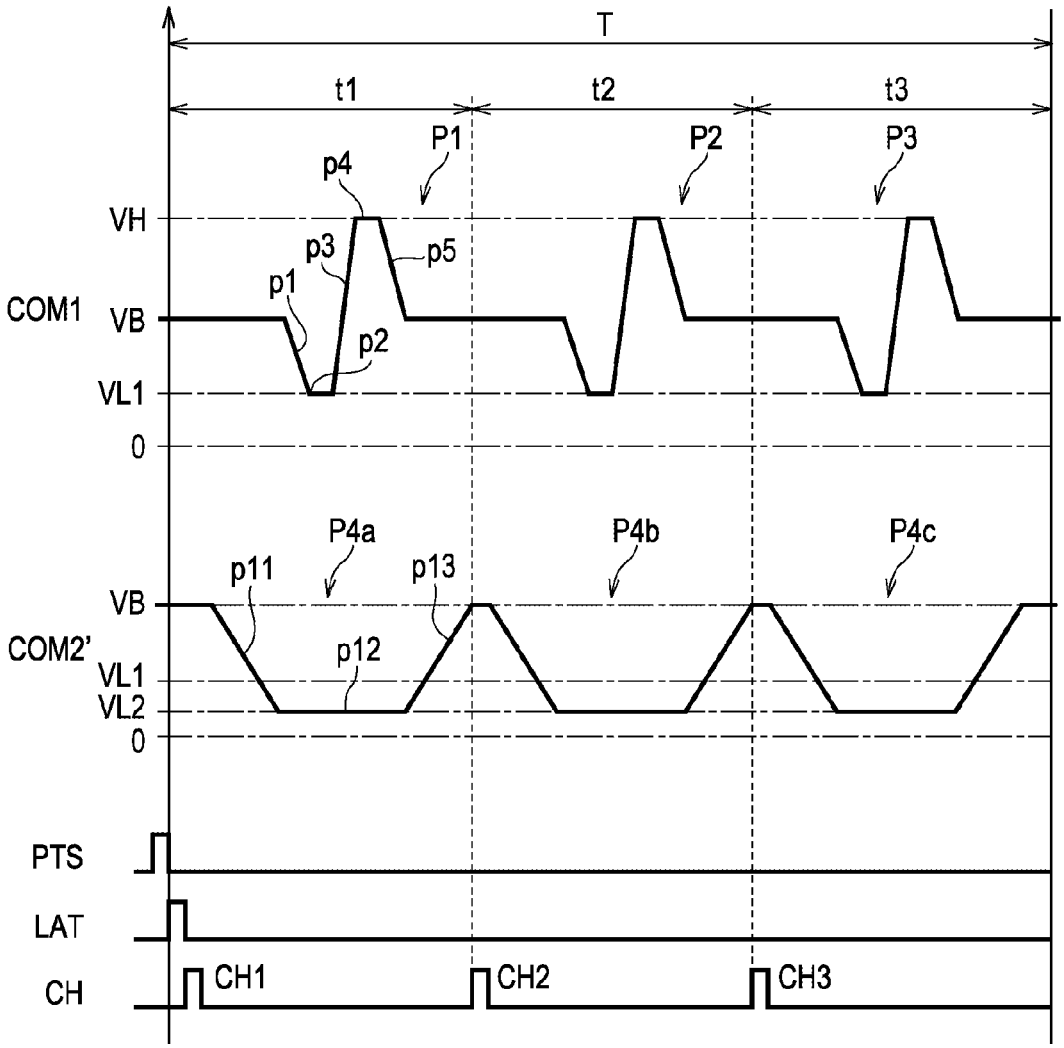
FIG. 10 is a waveform chart describing an activation signal configuration according to a third embodiment.

FIG. 10 is a waveform chart describing an activation signal configuration according to a third embodiment of the invention.

According to the first embodiment described above, a configuration is exemplified wherein the common micro-oscillating activation pulse P4 is provided in respect to the plurality of ejection activation pulses, but it is not limited to this. The third embodiment exemplified in FIG. 8 differs from the first embodiment described above in that the respective micro-oscillating activation pulses are separately provided so as to correspond to each ejection activation pulse. Since the configuration of the first activation signal COM1 is the same as in the first embodiment, the description will be omitted here. In the second activation signal COM2' according to the third embodiment, the unit cycle T is divided into a total of three periods, t1 to t3, in the same manner as in the first activation signal COM1, wherein a first micro-oscillating activation pulse P4*a* is produced in the period t1, a second micro-oscillating activation pulse P4*b* is produced in the period t2, and a third micro-oscillating activation pulse P4*c* is produced in the period t3. Each of the micro-oscillating activation pulses P4*a* to P4*c* are all the same waveform, including the micro-oscillating expansion element p11 that drops from the standard potential VB to the second expansion potential VL2, the micro-oscillating expansion hold element p12 that sustains the second expansion potential VL2 for a certain period of time, and the micro-oscillating contraction element p13 that rises from the second expansion potential VL2 to the standard potential VB. Furthermore, in the same manner as in the first embodiment described above, the second expansion potential VL2 is set to no greater than the first expansion potential VL1, which is the minimum electric potential of the ejection activation pulses P1 to P3.

Since the printing control according to the third embodiment is the same as for the first embodiment described above in terms of one or a plurality of ejection activation pulses P1 to P3 being supplied to the piezoelectric element 20 corresponding to the ejecting nozzle, the description thereof will be omitted here. In contrast to this, the third embodiment is configured such that the micro-oscillating activation pulse of a period corresponding to the ejection activation pulse applied to the piezoelectric element 20, corresponding to an ejecting nozzle, is selected and applied to the piezoelectric element 20 corresponding to a non-ejecting nozzle. By means of the configuration according to the third embodiment, the same effect as in the first embodiment described above is achieved. In other words, pressure loss during ink ejection in an ejecting nozzle can be reduced and crosstalk prevented.

As a liquid ejecting apparatus capable of ejection control of liquid using a so-called bending vibration type piezoelectric element, the invention is not limited to printers, but can also be applied to various types of ink jet printing apparatus such as plotters, facsimile apparatus and copying machines, as well as liquid ejecting apparatus other than printing apparatus, e.g. display fabrication apparatus, electrode fabrication apparatus and chip fabrication apparatus.

The entire disclosure of Japanese Patent Application No. 2010-228819, filed Oct. 8, 2010 is expressly incorporated by reference herein.

What is claimed is:

1. A liquid ejecting apparatus comprising:

a liquid ejecting head that has a nozzle for ejecting liquid, a pressure chamber in communication with the nozzle, and a pressure generator of deforming an operation surface for sealing an opening surface of the pressure chamber to induce pressure fluctuation in liquid within the pressure chamber and that ejects liquid from the nozzle by activation of the pressure generator;

an activation signal generator that generates an activation signal for activating the pressure generator; and a select-and-supply unit that selects an activation pulse contained in an activation signal generated by the activation signal generator and that supplies the pulse to the pressure generator, wherein the pressure generator is configured such that, as an applied electric potential increases above a standard electric potential corresponding to a standard condition where a central portion of the operation surface is located inside of the pressure chamber from the opening surface of the pressure chamber, the central portion of the operation surface is displaced from the standard condition to further inside of the pressure chamber, and, as an applied electric potential decreases below the standard electric potential, the central portion of the operation surface is displaced from the standard condition to outside of the pressure chamber, wherein the activation signal generator includes in the activation signal an ejection activation pulse for ejecting liquid from the nozzle, and a non-ejection activation pulse for inducing pressure fluctuation in liquid within the pressure chamber of a level such that liquid is not ejected from the nozzle, wherein a minimum electric potential of the non-ejection activation pulse is no greater than a minimum electric potential of the ejection activation pulse, and wherein the select-and-supply unit supplies the ejection activation pulse to a pressure generator corresponding to an ejecting nozzle ejecting liquid, and supplies the non-ejection activation pulse at least to a pressure generator corresponding to a non-ejecting nozzle located adjacent to the ejecting nozzle.

2. The liquid ejecting apparatus according to claim 1, wherein the ejection activation pulse at least includes a first dropping element for deforming the operation surface outside in respect to the pressure chamber from the standard condition by dropping a potential from the standard electric potential to the minimum electric potential, a first sustaining element for sustaining the minimum electric potential for a fixed length of time, and a first raising element for deforming the operation surface further inside in respect to the pressure chamber than the standard condition by raising a potential from the minimum electric potential to the standard electric potential, and wherein the non-ejection activation pulse at least includes a second dropping element for dropping a potential from the standard electric potential to the minimum electric potential of the ejection activation pulse, a second sustaining element for sustaining the minimum electric potential for a fixed length of time, and a second raising element for raising a potential from the minimum electric potential to the standard electric potential.

3. The liquid ejecting apparatus according to claim 2, wherein the second dropping element of the non-ejection activation pulse occurs prior to the first dropping element of the ejection activation pulse of the same cycle, and the second raising element of the non-ejection activation pulse occurs subsequent to the first raising element of the ejection activation pulse of the same cycle.

4. The liquid ejecting apparatus according to claim 1, wherein the minimum electric potential of the non-ejection activation pulse is lower than the minimum electric potential of the ejection activation pulse, thereby:

bending the operation surface corresponding to the non-ejecting nozzle toward the outside of the pressure chamber corresponding to the non-ejecting nozzle to a first bending amount; and bending the operation surface corresponding to the ejecting nozzle toward the outside of the pressure chamber corresponding to the ejecting nozzle to a second bending amount;

wherein the first bending amount is greater than the second bending amount, such that a partition between the ejecting nozzle and the non-ejecting nozzle is pressed toward the inside of the pressure chamber corresponding to the non-ejecting nozzle by a portion of the operation surface corresponding to the non-ejecting nozzle.

5. A method of controlling a liquid ejecting apparatus including a liquid ejecting head that has a nozzle for ejecting liquid, a pressure chamber in communication with the nozzle, and a pressure generator of deforming an operation surface for sealing an opening surface of the pressure chamber to induce pressure fluctuation in liquid within the pressure chamber and that ejects liquid from the nozzle by activation of the pressure generator, an activation signal generator that generates an activation signal for activating the pressure generator, and a select-and-supply unit that selects an activation pulse contained in an activation signal generated by the activation signal generator and that supplies the pulse to the pressure generator, the pressure generator configured such that, as an applied electric potential increases above a standard electric potential corresponding to a standard condition where a central portion of the operation surface is located inside of the pressure chamber from the opening surface of the pressure chamber, the central portion of the operation surface is displaced from the standard condition to further inside of the pressure chamber, and, as an applied electric potential decreases below the standard electric potential, the central portion of the operation surface is displaced from the standard condition to outside of the pressure chamber, and the activation signal generator including in the activation signal an ejection activation pulse for ejecting liquid from the nozzle, and a non-ejection activation pulse for inducing pressure fluctuation in liquid within the pressure chamber of a level such that liquid is not ejected from the nozzle, the method comprising:

setting a minimum electric potential of the non-ejection activation pulse to no greater than a minimum electric potential of the ejection activation pulse;

supplying the ejection activation pulse to a pressure generator corresponding to an ejecting nozzle ejecting liquid; and supplying the non-ejection activation pulse at least to the pressure generator corresponding to the non-ejecting nozzle located adjacent to the ejecting nozzle.

* * * * *